United States Patent [19]

Yoon et al.

[11] Patent Number: 4,629,556

[45] Date of Patent: Dec. 16, 1986

[54] PURIFICATION OF KAOLIN CLAY BY FROTH FLOTATION USING HYDROXAMATE COLLECTORS

[75] Inventors: Roe-Hoan Yoon, Blacksburg, Va.; Thomas M. Hilderbrand, Grovetown, Ga.

[73] Assignee: Thiele Kaolin Company, Sandersville, Ga.

[21] Appl. No.: 676,477

[22] Filed: Nov. 29, 1984

[51] Int. Cl.[4] ..... B03D 1/12

[52] U.S. Cl. ..... 209/166; 252/61; 75/1 T

[58] Field of Search ..... 209/166; 252/61; 75/1 T

[56] References Cited

U.S. PATENT DOCUMENTS

| | | | |
|---|---|---|---|
| 2,990,958 | 7/1961 | Greene et al. . | |
| 3,432,030 | 3/1969 | Oliver . | |
| 3,438,494 | 4/1969 | Fuerstenau et al. . | |
| 3,450,257 | 6/1969 | Cundy et al. . | |
| 4,461,701 | 7/1984 | Rinelli et al. | 75/1 T |
| 4,492,628 | 1/1985 | Young et al. | 209/166 |

FOREIGN PATENT DOCUMENTS

| | | | |
|---|---|---|---|
| 774601 | 10/1980 | U.S.S.R. | 209/166 |
| 871831 | 10/1981 | U.S.S.R. | 209/166 |

OTHER PUBLICATIONS

Marabini et al, Soc. of Mining Engineers, p. 1 preprint 82-50, 2/82.

Lenormand et al—Hydroxyamate Floatation of Malachite, vol. 18, pp. 125-129 (1979) Canadian Metalurgical Quarterly.

Effect of Crystal Structure on the Surface Properties of a Series of Manganese Dioxides, Healy et al, Journal of Colloid and Interphase Science, vol. 21, pp. 435-444 (1966).

*Primary Examiner*—Bernard Nozick

*Attorney, Agent, or Firm*—Marshall, O'Toole Gerstein, Murray & Bicknell

[57] ABSTRACT

An improved flotation process for removal of colored titaniferous impurities from kaolin clay uses as collector a hydroxamate compound, or a mixture of compounds, having the formula

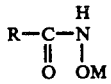

in which R is an alkyl, aryl, or alkylaryl group having 4-28, and preferably 6-24 carbon atoms, and M represents an alkali metal, an alkaline earth metal or hydrogen. The process does not require the use of activators to make the collector adsorb selectively on the colored impurities.

11 Claims, No Drawings

PURIFICATION OF KAOLIN CLAY BY FROTH FLOTATION USING HYDROXAMATE COLLECTORS

The present invention relates to an improved froth flotation process for removing colored impurities from kaolin clay using alkyl, aryl, or alkylaryl hydroxamates as collectors, which does not require the use of activators to make these collectors adsorb selectively on the colored impurities.

BACKGROUND OF THE INVENTION

Crude kaolin clay, as mined, contains various forms of discoloring elements, two major impurities being anatase ($TiO_2$) and iron oxides. In order to make the clay more acceptable for use in the paper industry, these impurities must be substantially removed by appropriate techniques. The production of high brightness clay usually includes two processing steps. In the first step, a significant portion of the impurities, mainly anatase, is removed by employing one or two physical separation techniques, such as high gradient magnetic separation (HGMS), froth flotation and selective flocculation. In the second step, the remaining impurities, mainly iron oxides, are removed by chemical leaching.

Froth flotation is regarded as one of the most efficient methods of removing colored impurities from clay, although some variations may be necessary for improved results. For example, the use of carrier particles or oil droplets to improve fine particle flotation has been suggested in U.S. Pat. Nos. 2,990,958 and 3,432,030, respectively. Nevertheless, practically all of the known flotation processes are based on the use of the fatty acidor tall oil-type of reagents called "collectors" that are designed to render the colored impurities selectively hydrophobic. Use of these reagents, however, requires the use of monovalent, divalent, or trivalent cations called "activators". This makes the process sometimes difficult to control as it is necessary to maintain a proper balance between the amounts of collector and activator added. An excessive use of activators can induce coagulation of the clay particles and makes the separation difficult. Also, activators can cause the flotation of the clay particles themselves rather than the colored impurities, resulting in a poor separation efficiency and a loss of clay recovery.

It is therefore, desirable to have a collector for colored impurities that does not require activators. It has been reported (Marabini and Rinelli, AIME Preprint No. 82-50, February, 1982) that N-phenylbenzohydroxamic acid can be used as a collector for rutile, a polymorph of anatase, without the use of activators. The flotation of rutile using this reagent occurs at acidic pH values, however, and substantially no flotation is possible above pH 5. This result makes it difficult to remove impurities from clay because in acidic media, clay particles self-coagulate to form cages in which impurities are trapped. For this reason, physical separation processes involving kaolin clay are carried out in an alkaline, or only slightly acidic, medium in which the clay particles can be more readily dispersed. In addition, N-phenylbenzohydroxamic acid is prohibitively expensive and exceedingly large amounts of the reagent are required for good flotation.

U.S. Pat. No. 3,438,494 discloses the use of alkyl- or aryl-substituted hydroxamic acids or salts thereof as collectors for the flotation of chrysocolla, a copper-bearing silicate mineral, and iron oxides from ores containing these minerals. Similarly, potassium octyl hydroxamate has been reported (LeNormand, Salman and Yoon, Can.Met.Quarterly, Vol. 18, pp. 125–129) to be useful as a collector for the flotation of malachite, an oxidized copper mineral. No activators are necessary for the flotation of these minerals using hydroxamates, since these reagents are chelating agents specific for copper and iron. Neither of these references, however, suggests the use of hydroxamates for the flotation of titaniferous impurities from kaolin clays.

SUMMARY OF THE INVENTION

In accordance with the present invention, there is provided an improved flotation process by which kaolin clay can be cleaned of its colored impurities using a collector which can adsorb specifically on the colored mineral surfaces without requiring the use of activators. The process uses as collector a compound, or a mixture of compounds, having the formula

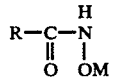

in which R is an alkyl, aryl, or alkylaryl group having 4–28, and preferably 6–24 carbon atoms, and M represents an alkali metal, an alkaline earth metal or hydrogen. Although it is convenient to use the reagents in the form of soluble salts, they can also be used as acids.

It has been found that these reagents are effective collectors for the flotation of titaniferous impurities from a variety of Middle Georgia clays, including those having creamy, reddish and tan discoloration. In addition, the process can be used for removing impurities from the East Georgia clays which, because of the presence of finer particles, are difficult to process by the conventional tall oil flotation technique.

The hydroxamate collectors can be used effectively at pH values above 6, at which the dispersion of clay is readily achieved. The amounts of these reagents required for flotation are considerably less than those typically used in the conventional tall oil flotation process. Also, the hydroxamate collectors used in the present invention possess frothing properties, so that no frothers may be necessary for flotation. However, a small amount of frother may be used when a starvation quantity of the collector is used.

DESCRIPTION OF THE PREFERRED EMBODIMENTS

The hydroxamate collectors used in the invention can be prepared by reacting free hydroxylamine with the methyl ester of an organic acid of appropriate hydrocarbon chain length and configuration, in a non-aqueous medium such as methanol. For example, potassium octylhydroxamate can be prepared by combining 1.0 mole of potassium hydroxide dissolved in 140 ml of methanol with 0.6 moles of hydroxylamine hydrochloride dissolved in 240 ml of methanol at 40° C. to form free hydroxylamine and KCl precipitate. The precipitate is removed by filtration and 0.33 moles of methyl octanoate is added to the filtrate to precipitate potassium octyl hydroxamate. After the precipitation is complete, the precipitate is recovered by filtration and dried.

Other hydroxamates can be prepared in a similar manner using the corresponding methyl ester of an appropriate organic acid. In addition to potassium octyl hydroxamate, other hydroxamates which can be made in this manner and which are useful in the process of the invention include potassium butyl hydroxamate, potassium lauryl hydroxamate, potassium 2-ethylhexyl hydroxamate, potassium oleyl hydroxamate, potassium eicosyl hydroxamate, potassium phenyl hydroxamate, potassium naphthyl hydroxamate, potassium hexylphenyl hydroxamate, and the coresponding salts of sodium and other alkali or alkaline earth metals. The salts can be converted to the corresponding acids by conventional methods known to those skilled in the art.

As a first step in carrying out the process of the invention, the clay to be purified is blunged in water at an appropriate solids concentration. A relatively high pulp density, in the range of 35–70% solids by weight, is preferred since the interparticle scrubbing action in such pulps helps liberate colored impurities from the surfaces of the clay particles. While high-speed, high-energy blunging, which tends to increase the scouring action, is preferred, low-speed, low-energy blunging can also be used.

Following conventional practice, a suitable dispersant, such as sodium silicate, polyacrylate, or polyphosphate, is added during blunging in an amount, e.g., 1–20 lb. per ton of dry solids, sufficient to produce a well-dispersed clay slip. An alkali, such as ammonium hydroxide, is also added as needed to produce a pH above 6 and preferably within the range of 8–10.5. Although the removal of anatase in accordance with the invention generally increases with increasing pH, excessive frothing may be encountered at values above about 10, which inhibits effective separation. Excessive foaming can be inhibited, if desired or necessary, by using a conventional defoaming agent, such as silicone or hydrocarbon oil.

The hydroxamate collector in accordance with the invention is then added to the dispersed clay slip under conditions, i.e., proper agitation speed, optimum pulp density, and adequate temperature, which permit reaction between the collector and the colored impurities of the clay in a relatively short time, generally not longer than 5–10 minutes.

The amount of hydroxamate collector added to the clay slip depends on the amount of impurities present in the clay, the nature of the clay to be processed, and the amounts of other reagents used in the process. In general, collector additions in the range of 0.1–18, and preferably 0.5–6, lb. per ton of dry clay will usually be effective.

When the clay slip has been conditioned after the addition of collector, it is transferred to a flotation cell, and if necessary or desirable, is diluted to a pulp density preferably within the range of about 15–45% solids by weight. The operation of the froth flotation machine is conducted in conventional fashion. After an appropriate period of operation, during which the titaniferous impurities are removed with the foam, the clay suspension left in the flotation cell can be leached for the removal of residual iron oxides, filtered, and dried in conventional fashion.

The process of the invention is illustrated in the specific examples which follow. In this work, a run-of-mine crude clay sample was typically blunged in a six-inch baffled container using a 3-inch diameter Cowles-type blade rotating at 6,200 rpm to mix the slurry. In some cases, a mixer operating at 2,300 rpm with a Denver opposed-pitch, 3-bladed, dual propeller was used. In each test, a sample of crude clay containing 20–25% moisture was used in an amount to provide 1,000 or 2,000 grams of bone dry clay. With the 1,000-g samples, the pulp density was adjusted to 40% solids by adding demineralized water, while it was adjusted to 60% solids with the 2,000-g samples. For dispersion, sodium silicate (Chem-silate 41-A, $SiO_2/Na_2O=3.2:1$) was added together with sufficient ammonium hydroxide to produce a selected alkaline pH in the slurry after 6–10 minutes of blunging. After dispersion of the clay, the hydroxamate collector was added and the agitation was continued for another 6–10 minutes.

After conditioning, as described, the clay slip was transferred to a 5-liter cell of a Denver D-12 laboratory flotation cell or to a 10-liter cell of a Denver Sub-A flotation machine and diluted to 20% solids by adding demineralized water. The impeller speed of the Denver D-12 laboratory flotation cell was variable, while the impeller speed of the Denver Sub-A flotation machine was fixed at 1,725 rpm. The slurry was agitated for a few minutes before introducing air bubbles into the cell to start the flotation, which lasted for 1 hour unless otherwise indicated.

After the flotation was completed, a portion of the beneficiated clay suspension left in the flotation cell was removed for measurement of pulp density, from which the yield of treated clay was determined, and for X-ray fluorescence analysis to determine the residual $TiO_2$ content. The remainder of the beneficiated clay was classified by settling for a time selected so that at least 90% of the unsettled particles were finer than 2 microns equivalent spherical diameter. The fine fraction of the clay was coagulated by lowering the pH of the slurry to 2.5 with sulfuric acid and alum, leached with varying amounts of sodium hydrosulfite ($Na_2S_2O_4$), filtered, dried, and tested for brightness as described in Tappi Standard T-646, OS-75.

For comparison, some tests were carried out using a conventional tall oil flotation process, substantially as described in U.S. Pat. No. 3,450,257.

The clay samples used in the examples included Middle Georgia clay samples, i.e., run-of-mine clays from the Ennis Mine and the Avant Mine in Washington County, Ga. In these clays, approximately 60% of the particles were finer than 2 microns equivalent spherical diameter. Other tests were carried out using an East Georgia clay from the Hinton Mine, Warren County, Ga., in which approximately 90% of the particles were finer than 2 microns equivalent spherical diameter.

EXAMPLE 1

A clay sample from the Ennis Mine, Area-11, having a free moisture of 22.7% was dispersed in the high-speed blunger at 6,200 rpm and 40% solids using 6 lb/ton of Chem-silate. This dispersant was supplied with 50% sodium silicate and 50% water, and the reagent addition was calculated on an "as received" basis. The pH was adjusted by adding varying amounts of ammonium hydroxide during blunging. After 6 minutes of blunging, 1 lb/ton of potassium octyl hydroxamate was added, and the agitation was continued for another 6 minutes at the same speed for conditioning. Flotation tests were carried out on the conditioned clay slip after diluting it to 20% solids using a Denver D-12 flotation machine operating at 1,800 rpm. Demineralized water was used for both blunging and flotation to obviate the possible effect of heavy metal ions that might be contained in tap water.

The results, given in Table I, indicate that the removal of anatase improves with increasing pH. The pH values shown in this table are those measured immediately after the conditioning. The % $TiO_2$ was reduced to a minimum of 0.66 at pH 9.6. Another test was run at pH 10.8 using 2 lb/ton of ammonium hydroxide and 1.3 lb/ton of sodium hydroxide, but at this high pH no separation was possible due to overfrothing.

TABLE I

Effect of pH on Removal of Anatase From a Middle Georgia Clay

| pH | $NH_4OH$ (lb/ton) | % $TiO_2$ in Clay Product | Clay Yield (% wt.) |
|---|---|---|---|
| 6.2 | 0.0 | 1.08 | 94.6 |
| 6.8 | 0.34 | 0.95 | 93.8 |
| 7.4 | 0.42 | 0.84 | 94.7 |
| 8.2 | 0.60 | 0.82 | 91.2 |
| 8.9 | 0.70 | 0.71 | 89.4 |
| 9.6 | 1.40 | 0.66 | 93.2 |
| Feed | — | 1.45 | 100.0 |

Collector: potassium octyl hydroxamate, 1 lb. per ton of clay.

EXAMPLE 2

A crude clay from the Ennis Mine, Area-11, was used in an amount equivalent to 1,000 grams of bone-dry clay in each test. Each sample was blunged at 6,200 rpm with 6 lb/ton of Chem-silate 41-A and 3 lb/ton of ammonium hydroxide. The pH measured after blunging remained within ±0.2 units of pH 10. Varying amounts of potassium octyl hydroxamate as collector were then added and the high-speed agitation continuation for another 6 minutes. The flotation tests were carried out using the Denver D-12 flotation machine at 1,800 rpm and at a pulp density of 20% solids.

The results, given in Table II, show the variation of % $TiO_2$ in the clay products at different collector additions. Also shown in this table are the brightnesses of the classified clay products after leaching with varying amounts of sodium hydrosulfite. The $TiO_2$ content in the products decreased with increasing collector addition, the lowest being 0.24% at 3 lb/ton. However, this improvement in the anatase removal was accompanied by a significant loss of yield, largely due to overfrothing. The collectors used in this invention have strong frothing properties, and a high dosage may produce excessive froth during flotation, causing the flotation of clay particles by mechanical entrainment.

TABLE II

Flotation Tests Conducted at pH 10 On a Middle Georgia Clay Using Varying Amounts of Potassium Octyl Hydroxamate as Collector

| Collector Addition (lb/ton) | % $TiO_2$ in Clay Product | Clay Yield (% wt.) | Brightness of the Classified Clay Products (lb/ton $Na_2S_2O_4$) 0 | 3 | 6 | 9 |
|---|---|---|---|---|---|---|
| 0.5 | 1.17 | 95.7 | 85.5 | 87.5 | 87.8 | 88.0 |
| 1.0 | 0.71 | 92.0 | 87.6 | 89.3 | 90.4 | 90.2 |
| 1.5 | 0.55 | 82.7 | 88.7 | — | 91.0 | 91.7 |
| 2.0 | 0.29 | 78.8 | 90.5 | — | 92.7 | 92.6 |
| 3.0 | 0.24 | 65.4 | 90.5 | — | 91.5 | 91.2 |
| Feed | 1.45 | 100.0 | | | | |

The brightness of the classified products reached a maximum of 92.7 when 2 lb/ton of collector and 6 lb/ton of sodium hydrosulfite were used for flotation and leaching, respectively. At 2 or 4 lb/ton of collector addition, the hydroxamate flotation method of the invention produced a clay with a brightness over 90 without leaching.

EXAMPLE 3

In this example potassium lauryl hydroxamate was used as a flotation collector. In general, a collector with a longer hydrocarbon chain exhibits a more potent collecting power and gives a higher flotation recovery. Therefore, the objective of this example was to establish the optimum level of collector addition required with potassium lauryl hydroxamate, and to compare the results with those obtained with potassium octyl hydroxamate. All the flotation tests were carried out at pH 10 on the assumption that these collectors have the same optimum pH. The procedures and the amounts of reagents used for blunging, conditioning, and flotation were identical to those described in Example 2.

Table III gives the results obtained on the crude clay from the Ennis Mine, Area-11. As the collector addition was increased from 0.5 to 3 lb/ton, the % $TiO_2$ progressively decreased, reaching a minimum of 0.36 at 2 lb/ton. The yields obtained with this longer hydrocarbon chain collector were significantly higher, however, than those obtained with potassium octyl hydroxamate. For example, a 90% yield was obtained, with the flotation product assaying as low as 0.36% $TiO_2$. Thus, a comparison of the results shown in Tables II and III indicates that the longer chain collector is more selective. One interesting observation made during the flotation experiments was that the longer chain lauryl hydroxamate produced a less vigorous froth than the shorter octyl hydroxamate, which may have been the primary reason for its superior selectivity.

TABLE III

Flotation Tests Conducted at pH 10 on a Middle Georgia Clay Using Varying Amounts Of Potassium Lauryl Hydroxamate as Collector

| Collector Addition (lb/ton) | % $TiO_2$ in Clay Product | Clay Yield (% wt.) | Brightness of the Classified Clay Products (lb/ton $Na_2S_2O_4$) 0 | 3 | 6 | 10 |
|---|---|---|---|---|---|---|
| 0.5 | 0.82 | 93.5 | 85.6 | 86.6 | 87.2 | 88.3 |
| 0.75 | 0.64 | 95.3 | 87.8 | 89.9 | 91.0 | 91.0 |
| 1.0 | 0.50 | 95.1 | 87.6 | 90.1 | 90.6 | 91.5 |
| 1.5 | 0.48 | 95.0 | 87.2 | 90.4 | 90.7 | 91.0 |
| 2.0 | 0.36 | 90.0 | 89.7 | 91.0 | 91.4 | 91.5 |
| 3.0 | 0.37 | 85.5 | 88.3 | 89.3 | 89.2 | 90.1 |
| Feed | 1.45 | 100.0 | | | | |

Table III also shows the brightness of the classified flotation products leached with varying amounts of sodium hydrosulfite. A brightness over 90 was readily obtained with yields as high as 95%, again demonstrating the excellent selectivity of potassium lauryl hydroxamate as a collector.

EXAMPLE 4

Another series of flotation tests was carried out using potasium oleyl hydroxamate as a collector, using the procedures and reagent additions of Example 3. The results given in Table IV show that the yields are high and the removal of anatase is significant.

TABLE IV

Flotation Tests Conducted at pH 10 on a Middle Georgia Clay Using Varying Amounts Of Potassium Oleyl Hydroxamate as Collector

| Collector Addition (lb/ton) | % $TiO_2$ in Clay Product | Clay Yield (% wt.) | Brightness of the Classified Clay Products ($lb/ton\ Na_2S_2O_4$) 0 | 3 | 6 | 10 |
|---|---|---|---|---|---|---|
| 0.5 | 1.0 | 96.3 | 85.9 | 86.4 | 87.3 | 88.0 |
| 0.75 | 0.96 | 96.6 | 85.3 | 86.2 | 87.4 | 87.7 |
| 1.0 | 0.98 | 97.0 | 86.2 | 88.4 | 89.1 | 89.0 |
| 1.5 | 0.85 | 96.5 | 86.7 | 89.5 | 89.1 | 89.0 |
| 2.0 | 0.77 | 94.7 | 86.5 | 88.6 | 88.5 | 89.4 |
| 3.0 | 0.75 | 94.6 | 86.8 | 87.2 | 88.4 | 90.0 |
| Feed | 1.45 | 100.0 | | | | |

EXAMPLE 5

In the previous examples, flotation tests were carried out using a Denver D-12 laboratory flotation machine with 1,000 grams of clay. In this example, a larger flotation machine (Denver Sub-A) was employed; and each test was conducted using a crude clay (Ennis Mine, Area-11) in an amount equivalent to 2,000 grams of bone-dry clay. Two runs were carried out in parallel for comparison, one using tall oil as collector and the other using potassium octyl hydroxamate as collector. Tall oil is the most extensively used collector in the commercial processing of kaolin clay.

The procedure used for the tall oil flotation were similar to that described in U.S. Pat. No. 3,450,257. Initially, the clay sample was blunged at 6,200 rpm for 10 minutes at 65% solids using 8 lb/ton of Chem-silate 41-A, 2 lb/ton of ammonium hydroxide, and 0.25 lb/ton of calcium acetate as activator. Three lb/ton of Hercules Pamak-4 tall oil was then added to the dispersed clay slip, and the high-speed mixing continued for another 10 minutes. The clay slip, conditioned as such, was transferred to the flotation cell and diluted to 20% solids with demineralized water. After adding 2.3 lb/ton of calcium acetate, the diluted slurry was agitated for 5 minutes at 1,725 rpm before introducing air into the cell to commence flotation. The flotation test lasted for one hour.

For hydroxamate flotation, the clay sample was dispersed in the same manner described for the tall oil flotation, except that no activator was used. The dispersed clay slip was conditioned with 1.5 lb/ton of potassium octyl hydroxamate for 10 minutes in the high-speed blunger before subjecting it to flotation for 1 hour.

Table V sets out the results of the two flotation tests. As shown, the hydroxamate flotation technique is superior to the conventional tall oil flotation process. A maximum brightness of 93.0 was achieved with the hydroxamate, while with tall oil the maximum was only 90.2. The hydroxamate flotation technique produced a clay assaying as low as 0.16% $TiO_2$, and the classified flotation product had a brightness of 92.4 even without leaching.

TABLE V

Comparison of Tall Oil Flotation and Hydroxamate Flotation on a Middle Georgia Clay

| Collector | Collector Addition (lb/ton) | % $TiO_2$ in Clay Product | Clay Yield (% wt) | Brightness of the Classified Clay Products ($lb/ton\ Na_2S_2O_4$) 0 | 3 | 6 | 10 |
|---|---|---|---|---|---|---|---|
| Tall Oil | 3.0* | 0.48 | 94.5 | 88.7 | 88.8 | 89.7 | 90.2 |

TABLE V-continued

Comparison of Tall Oil Flotation and Hydroxamate Flotation on a Middle Georgia Clay

| Collector | Collector Addition (lb/ton) | % $TiO_2$ in Clay Product | Clay Yield (% wt) | Brightness of the Classified Clay Products ($lb/ton\ Na_2S_2O_4$) 0 | 3 | 6 | 10 |
|---|---|---|---|---|---|---|---|
| Potassium Octyl Hydroxamate | 1.5 | 0.16 | 86.4 | 92.4 | 93.0 | 93.0 | 93.0 |
| Feed | | 1.42 | 100.0 | | | | |

*Used in conjunction with an activator (calcium acetate - 2.55 lb/ton)

It may be noteworthy that the results obtained with the Denver Sub-A flotation machine were better than those obtained with the Denver D-12. Two possible reasons may be considered. Firstly, the former produces finer air bubbles than the latter. It is now well established that the flotation of fine particles can be improved by using smaller bubbles. Secondly, the high pulp density blunging and conditioning may be beneficial to the flotation. Perhaps the colored impurities are liberated from the clay particles more readily due to the more vigorous scrubbing action in the highly concentrated pulp.

EXAMPLE 6

It has been demonstrated in the previous examples that hydroxamates are good collectors for processing cream-colored clays such as that from the Ennis Mine, Area-11. In this example, two other Middle Georgia clays were tested using potassium octyl hydroxamate as collector. These include a reddish clay from the Ennis Mine, Area-13, and a tan clay from the Avant Mine.

With each clay, two parallel experiments were carried out using tall oil and potassium octyl hydroxamate as collectors. The tall oil flotation was conducted using the Denver Sub-A machine with a crude clay sample having 2,000 grams of bone-dry clay, while the hydroxamate flotation was carried out using the Denver D-12 machine with only 1,000 grams of dry clay. Also, for tall oil flotation, the clay sample was blunged and conditioned at 60% solids, while only 40% solids was used in the hydroxamate flotation. The procedure for tall oil flotation was the same as that described in Example 5. The only modification made in this example was that the tall oil was a different brand, i.e., Westvaco L-5, of tall oil fatty acid. For hydroxamate flotation, the procedures were basically the same as in previous examples; for blunging, 6 lb/ton of Chem-silate 41-A and 3 lb/ton of ammonium hydroxide were used, and for conditioning, 1 lb/ton of collector was used.

As has already been noted in Example 5, the flotation tests conducted with the Denver Sub-A machine appear to produce better results than those conducted with the Denver D-12 machine. Thus, the hydroxamate flotation tests conducted using the latter equipment may have been handicapped, but the results are still superior to those of the conventional tall oil flotation process, as shown in Table VI. With the reddish clay from the Ennis Mine, Area-13, the hydroxamate flotation produced a higher brightness clay by more than 4 points, while with the tan clay from the Avant Mine, the brightness is only 2 points higher. As shown, it is difficult to upgrade these two clays to high brightness by the tall oil flotation process, but both have been readily upgraded to a brightness over 90 in accordance with the invention.

TABLE VI

Comparison Of Tall Oil Flotation and Hydroxamate Flotation on Reddish and Tan Middle Georgia Clays

| Clay Sample | Collector | Collector Addition (lb/ton) | $TiO_2$ in Clay Product (% wt) | Clay Yield (% wt) | Brightness of the Classified Clay Products (lb/ton $Na_2S_2O_4$) 10 | 3 | 6 | 10 |
|---|---|---|---|---|---|---|---|---|
| Ennis Mine Area-13 (Reddish) | Tall Oil | 3.0* | 1.45 | 80.3 | 82.9 | 84.3 | 85.6 | 86.0 |
| Ennis Mine Area-13 (Reddish) | Potassium Octyl Hydroxamate | 1.5 | 0.37 | 77.0 | 87.7 | 89.9 | 90.4 | 90.1 |
| Feed | | | 1.60 | 100.0 | | | | |
| Avant Mine S10 W 89 (Tan) | Tall Oil | 3.0* | 0.73 | 92.7 | 85.2 | 87.9 | 87.6 | 88.0 |
| Avant Mine S10 W 89 (Tan) | Potassium Octyl Hydroxamate | 1.5 | 0.38 | 83.6 | 87.6 | — | 90.0 | 90.6 |
| Feed | | | 1.53 | 100.0 | | | | |

*Used in conjunction with an activator (calcium acetate - 2.55 lb/ton)

EXAMPLE 7

Because of its finer particle content, it is more difficult to upgrade an East Georgia clay by flotation than to upgrade a Middle Georgia clay. The objective of this example was, therefore, to demonstrate the hydroxamate flotation process on an East Georgia clay.

The clay sample used in this work was from the Hinton Mine, Warren County, Ga. Two tests were carried out: one using 3 lb/ton of Hercules Pamak-4 tall oil as collector in conjunction with 2.55 lb/ton of calcium acetate as activator, the other using 1.5 lb/ton of potassium octyl hydroxamate as collector alone. Each test was made with a sample equivalent to 2,000 grams of bone-dry clay using a Denver D-12 flotation machine. Prior to flotation, the clay was dispersed and conditioned for 6 minutes at 60% solids using the high-speed blunger. Chem-silate 41-A (14 lb/ton) and ammonium hydroxide (2 lb/ton) were used for dispersion.

The results are given in Table VII. The hydroxamate flotation technique produced a brightness over 90, while the conventional tall oil flotation technique did not.

TABLE VII

Comparison Of Tall Oil Flotation and Hydroxamate Flotation on an East Georgia Clay

| Collector | Collector Addition (lb/ton) | % $TiO_2$ in Clay Product | Clay Yield (% wt) | Brightness of the Classified Clay Products (lb/ton $Na_2S_2O_4$) 0 | 3 | 6 | 10 |
|---|---|---|---|---|---|---|---|
| Tall Oil | 3.0* | 1.65 | 80.8 | 84.7 | 87.6 | 88.3 | 88.6 |
| Potassium Octyl Hydroxamate | 1.5 | 1.11 | 80.7 | 87.3 | 89.6 | 90.6 | 90.7 |
| Feed | | 2.35 | 100.0 | | | | |

*Used in conjunction with an activator (calcium acetate - 2.55 lb/ton)

EXAMPLE 8

In all of the previous examples, a high-speed blunger operating at 6,200 rpm was used for dispersion and conditioning. It is possible, however, to acheive good flotation after a lower speed blunging and conditioning, although the agitation time may have to be extended. The results given in Table VIII are from a flotation test carried out on a Middle Georgia clay conditioned in a low-speed blunger. A crude clay sample from the Ennis Mine, Area-11, equivalent to 1,000 grams of bone-dry clay, was blunged for 10 minutes at 2,280 rpm and at a pulp density of 40% solids using 6 lb/ton of Chem-silate 41-A and 3 lb/ton of ammonium hydroxide. The agitation continued for another 45 minutes after the addition of 1 lb/ton of potassium octyl hydroxamate. The flotation was then carried out for 1 hour using a Denver D-12 flotation machine at 20% solids. The results, shown in Table VIII, are comparable to those obtained using the high-speed blunger (Table II).

TABLE VIII

Flotation Test Conducted On a Middle Georgia Clay Without Using High Speed Agitation

| Collector* Addition (lb/ton) | % $TiO_2$ in Clay Product | Clay Yield (% wt.) | Brightness of the Classified Clay Products (lb/ton $Na_2S_2O_4$) 0 | 3 | 6 | 9 |
|---|---|---|---|---|---|---|
| 1.5 | 0.73 | 91.8 | 87.0 | 90.0 | 90.4 | 90.4 |
| Feed | 1.45 | 100.0 | | | | |

*Potassium octyl hydroxamate

The foregoing detailed description has been given for clearness of understanding only and no unnecessary limitations should be understood therefrom, as modifications will be obvious to those skilled in the art.

What is claimed is:

1. In a method for removing anatase impurities from a kaolin clay wherein the impure clay in aqueous suspension is first conditioned by treatment with a collector in an amount sufficient for promoting flotation of said impurities and then subjected to froth flotation for removal of said impurities for said clay, the improvement comprising using as said collector a compound having the formula

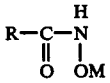

wherein R is an alkyl, aryl, or alkylaryl group having 4–28 carbon atoms and M is hydrogen, an alkali metal, or an alkaline earth metal, said suspension having a pH above 6.

2. A method in accordance with claim 1 wherein R has 6–24 carbon atoms.

3. A method in accordance with claim 1 wherein said suspension has a pH of 8–10.5.

4. A method in accordance with claim 1 wherein M is an alkali metal or an alkaline earth metal and R is an alkyl group having 8–18 carbon atoms.

5. A method in accordance with claim 1 wherein said froth flotation is carried out in the absence of any additional frothing agent.

6. A method in accordance with claim 1 wherein said suspension contains an effective concentration of a dispersant.

7. A method in accordance with claim 6 wherein said dispersant is selected from sodium silicate, sodium polyacrylate, and sodium polyphosphate.

8. A method in accordance with claim 1 wherein said suspension contains about 35–70% of clay solids by weight during said conditioning.

9. A method in accordance with claim 8 wherein said suspension is diluted with water to a clay solids concentration of about 15–45% by weight prior to said froth flotation.

10. A method in accordance with claim 1 wherein said suspension contains about 0.1–18 lb of said collector per ton of clay.

11. A method in accordance with claim 8 wherein said suspension contains about 0.5–6 lb of said collector per ton of clay.

* * * * *